US007499005B2

(12) United States Patent
Chung et al.

(10) Patent No.: US 7,499,005 B2
(45) Date of Patent: Mar. 3, 2009

(54) PLASMA DISPLAY PANEL AND DRIVING METHOD THEREOF

(75) Inventors: Woo-Joon Chung, Suwon-si (KR); Jin-Sung Kim, Suwon-si (KR); Seung-Hun Chae, Suwon-si (KR); Byung Hak Lee, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 785 days.

(21) Appl. No.: 11/017,056

(22) Filed: Dec. 21, 2004

(65) Prior Publication Data

US 2005/0134535 A1 Jun. 23, 2005

(30) Foreign Application Priority Data

Dec. 22, 2003 (KR) ..... 10-2003-0094880

(51) Int. Cl.
*G09G 3/28* (2006.01)

(52) U.S. Cl. ..... 345/67

(58) Field of Classification Search ..... 313/581–587; 315/169.4; 345/60–72
See application file for complete search history.

(56) References Cited

U.S. PATENT DOCUMENTS 5,570,104 A * 10/1996 Hayashi ..... 345/60
5,939,828 A * 8/1999 Matsuzaki et al. ..... 313/584
6,262,699 B1 7/2001 Suzuki et al.
6,614,411 B2 * 9/2003 Hayashi ..... 345/60
2001/0024092 A1 * 9/2001 Kim et al. ..... 315/169.4
2002/0021265 A1 * 2/2002 Ishii et al. ..... 345/60

FOREIGN PATENT DOCUMENTS

CN 1217519 5/1999
CN 1284704 2/2001
CN 1393840 1/2003
JP 2001134232 A * 5/2001

OTHER PUBLICATIONS

J.S. Choi, et al., High Luminous Efficiency of PDP with 'Twin Cell Structure' PDP R&D Team, Orion Electric Co. Ltd., IDW '02, pp. 1-4.
Y. Tanaka, et al., A new progressive driving scheme for a PDP with "Castle" structure; NEC Corp., Color PDP Division, Asia Display/IDW '01, pp. 1-4.

* cited by examiner

*Primary Examiner*—Sumati Lefkowitz
*Assistant Examiner*—Robert E Carter, III
(74) *Attorney, Agent, or Firm*—H.C. Park & Associates, PLC

(57) ABSTRACT

A plasma display panel includes a first substrate and a second substrate facing each other with a plurality of discharge cells formed therebetween. A plurality of scan electrodes and a plurality of sustain electrodes are alternately arranged on the second substrate, and a discharge cell comprises a first sustain electrode, a second sustain electrode, and a scan electrode.

13 Claims, 8 Drawing Sheets

PLASMA DISPLAY PANEL AND DRIVING METHOD THEREOF

CROSS REFERENCE TO RELATED APPLICATION

This application claims priority to and the benefit of Korean Patent Application No. 10-2003-0094880, filed on Dec. 22, 2003, which is hereby incorporated by reference for all purposes as if fully set forth herein.

BACKGROUND OF THE INVENTION

1. Field of the Invention

The present invention relates to a plasma display panel (PDP) and a driving method thereof.

2. Discussion of the Background

Generally, a PDP displays images by exciting a phosphor with ultraviolet rays from gas discharge occurring in a discharge cell. The PDP may be classified as an AC type and a DC type according to driving voltage waveforms and discharge cell structure, and may be classified as a facing or surface discharge type according to electrode construction. Three electrode surface discharge type PDPs are commonly used.

A conventional three electrode, surface discharge PDP includes a plurality of address electrodes arranged in a column direction on a rear substrate and covered with a dielectric layer. Barrier ribs may be arranged in the column direction on the dielectric layer between, and in parallel with, adjacent address electrodes. A phosphor layer is typically formed on the surface of the dielectric layer and the sides of the barrier ribs. Further, a scan electrode and sustain electrode pair are arranged in parallel in a row direction on the front substrate and sequentially covered with an upper dielectric layer and a protective layer. The front and rear substrates are arranged facing each other with a discharge space formed therebetween, so that the scan electrodes and the sustain electrodes are perpendicular to the address electrodes. Discharge spaces at intersections of the address electrodes and the scan and sustain electrode pairs form discharge cells. Additionally, a PDP having a closed type of barrier rib construction has recently been applied to improve discharge properties. Such PDPs may have row barrier ribs arranged on the dielectric layer of the rear substrate such that they pass between closed discharge cells in a column direction.

Generally, in a PDP driving method, one frame may be divided into a plurality of subfields, and each subfield may comprise a reset period, an address period, and a sustain period.

The reset period is a period for erasing wall charges formed by a previous sustain discharge and for setting up the wall charge in order to stably perform a subsequent address discharge. The address period is a period for selecting cells to be turned on and turned off and for accumulating a wall charge on the turned on cell (addressed cell). The sustain period is a period for performing a sustain discharge to display an image on the addressed cell.

More specifically, in the address period, turn-on/turn-off pattern signals are applied to the address electrodes while applying a scan voltage to corresponding scan electrodes and non-scan voltages to the remaining scan electrodes. An address discharge occurs between a scan electrode and a corresponding address electrode to which the turn-on pattern signal has been applied to form a wall charge. In the sustain period, a sustain discharge waveform may be alternately applied to the sustain electrode and the scan electrode of all discharge cells, and sustain discharges occur at the discharge cells in which the wall charge is formed in the address period.

FIG. 1 shows a a conventional PDP with a closed type barrier rib construction.

As shown in FIG. 1, an address electrode 2 and a barrier rib (not shown) are arranged in a column direction, and barrier ribs 3 are arranged in a row direction, on a rear substrate 1. Further, a scan electrode 6 and a sustain electrode 7 pair are arranged on a front substrate 5 between the barrier ribs 3.

Generally, the address discharge, which is one of the most important aspects regarding PDP driving, is affected by structures (especially, the barrier rib) in the discharge space. In particular, in a PDP having the closed barrier rib structure, the address discharge may be relatively weak, thereby requiring a high address voltage.

Further, with a PDP using high pressure gas, including high partial pressure of Xe, has been developed. However, in a highly efficient PDP, the level of brightness occurring by a one time sustain discharge may be very high, which may make for poor low gray scale expression.

SUMMARY OF THE INVENTION

The present invention provides a PDP and a driving method thereof that may easily generate an address discharge.

The present invention also provides a PDP and a driving method thereof that may improve low gray scale expression by decreasing the brightness level of each light, thereby decreasing the brightness level of a single sustain discharge.

Additional features of the invention will be set forth in the description which follows, and in part will be apparent from the description, or may be learned by practice of the invention.

The present invention discloses a plasma display panel comprising a first substrate and a second substrate facing each other with a plurality of discharge cells therebetween, and a plurality of scan electrodes and a plurality of sustain electrodes alternately arranged on the second substrate. A discharge cell comprises a first sustain electrode, a second sustain electrode, and a scan electrode.

The present invention also discloses a driving method for a plasma display panel including a first substrate and a second substrate facing each other with a plurality of discharge cells therebetween, a plurality of address electrodes arranged on the first substrate, and a plurality of scan electrodes and a plurality of sustain electrodes alternately arranged on the second substrate. A discharge cell comprises a first sustain electrode, a second sustain electrode, and a scan electrode. The driving method comprises applying a scan voltage to the scan electrode and applying an address voltage to an address electrode for performing an address discharge, and alternately applying a sustain discharge voltage to the scan electrode and either the first sustain electrode or the second sustain electrode to perform a sustain discharge at an addressed discharge cell in a sustain period.

The present invention also discloses a plasma display device comprising a plasma display panel, a first sustain electrode driver, a second sustain electrode driver, and a scan electrode driver. The plasma display panel a first substrate and a second substrate facing each other with a plurality of discharge cells therebetween, a plurality of scan electrodes and a plurality of sustain electrodes alternately arranged on the second substrate, and wherein a discharge cell comprises an odd numbered sustain electrode, an even numbered sustain electrode, and a scan electrode. The first sustain electrode driver, which applies a sustain discharge voltage, is coupled to odd numbered sustain electrodes, and the second sustain electrode driver, which applies a sustain discharge voltage, is coupled to even numbered sustain electrodes. The scan electrode driver, which applies a scan signal and a sustain discharge voltage, is coupled to the plurality of scan electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
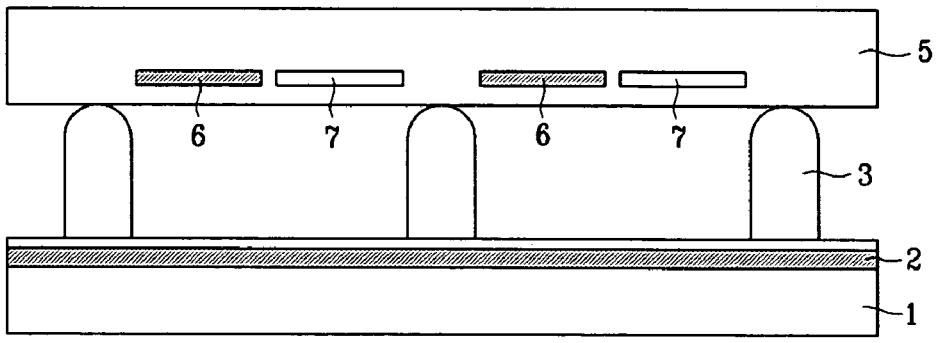
FIG. 1 shows a conventional PDP.

The following detailed description shows and describes exemplary embodiments of the invention. As will be realized, the invention is capable of modification in various obvious respects, all without departing from the invention. Accordingly, the drawings and description are to be regarded as illustrative in nature, and not restrictive. To clarify the present invention, parts which are not described in the specification are omitted, and parts for which similar descriptions are provided have the same reference numerals. The thickness is magnified to clearly describe several layers and area in drawings. When a layer, a membrane, a board, etc., are described to be located 'on' another part, it is understood that another part can be located therebetween.

Hereinafter, a PDP and a driving method thereof according to an exemplary embodiment of the present invention are described in detail with reference to drawings.

Figure 2:
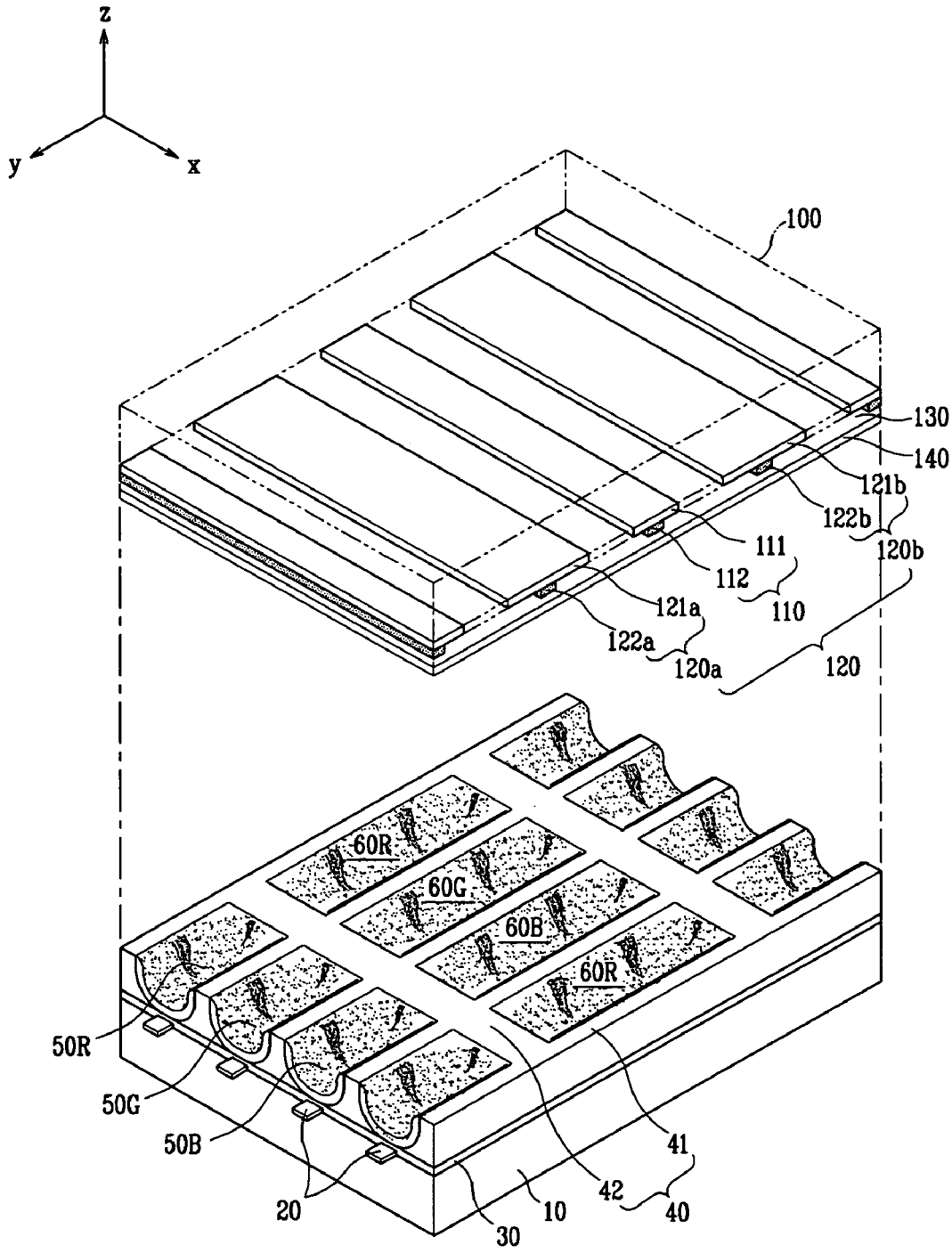
FIG. 2 is a partial perspective view showing a PDP according to an exemplary embodiment of the present invention.
Figure 3:
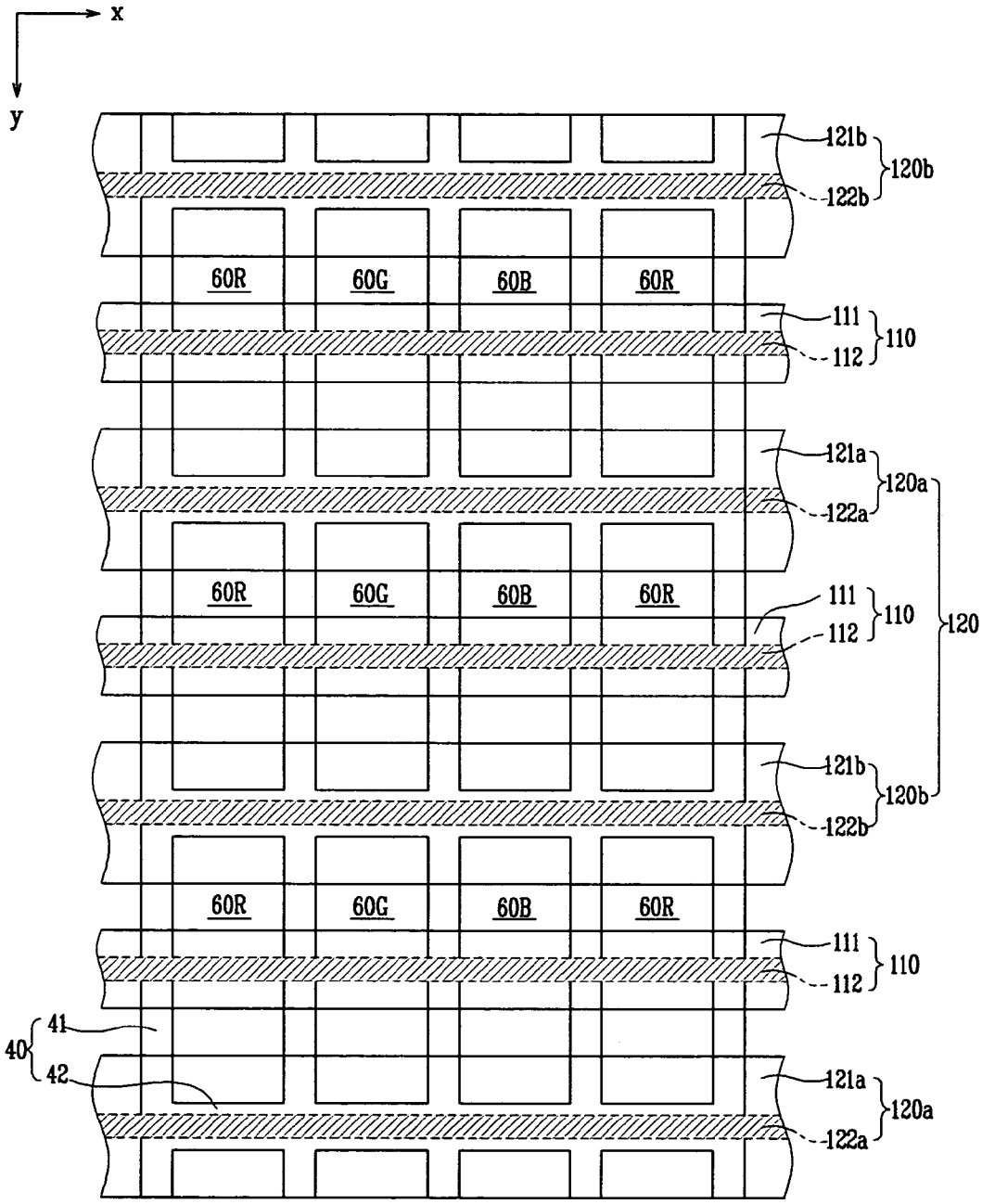
FIG. 3 is a partial plane view of the PDP of FIG. 2.
Figure 4:
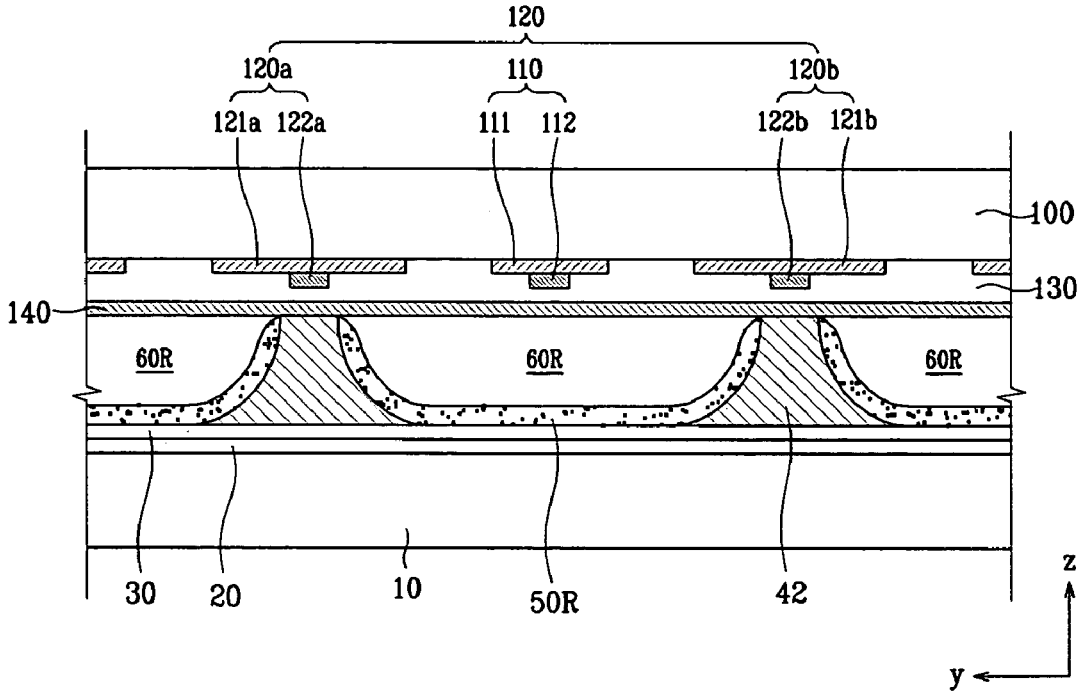
FIG. 4 is a partial sectional view showing the PDP of FIG. 2.

FIG. 2 shows is a partial perspective view of a PDP according to an exemplary embodiment of the present invention, FIG. 3 shows a partial plane view of the PDP of FIG. 2, and FIG. 4 shows a partial sectional view of the PDP of FIG. 2.

Referring to FIG. 2, FIG. 3 and FIG. 4, the PDP according to an exemplary embodiment of the present invention includes a rear substrate 10 and a front substrate 100 facing each other with a space formed therebetween.

A plurality of address electrodes 20 may be arranged in a Y direction on the rear substrate 10, which may be made from a material such as glass. A dielectric layer 30 covers the address electrodes 20, and barrier ribs 40 are formed on the dielectric layer 30. The barrier ribs 40 include a plurality of column barrier ribs 41 arranged in a column direction (Y direction) and a plurality of row barrier ribs 42 arranged in a row direction (X direction). The column barrier ribs 41 may be arranged on the dielectric layer 30 and formed between two adjacent address electrodes 20. The row barrier ribs 42 and the column barrier ribs 41 divided discharge cells 60R, 60B, and 60G, which are spaces for gas discharge and light emission. Red, green, and blue phosphors are spread in the discharge cells 60R, 60G, and 60B, respectively, to form phosphorous layers 50R, 50G, and 50B.

The front substrate 100 includes scan (Y) electrodes 110 and sustain (X) electrodes 120, which lie in a direction (X direction) perpendicular to the address electrodes 20. Further, a second dielectric layer 130, which is transparent, covers the X and Y electrodes 110, 120, and a protective layer 140, which may be formed of MgO, covers the second dielectric layer 130.

Address discharges occur between the Y electrodes 110 and the address electrodes 20 to select discharge cells 60R, 60G, and 60B. The X electrodes 120*a* and 120*b* interact with the Y electrodes 110 to initiate and sustain the discharge in the discharge cells 60R, 60G, and 60B. The Y electrodes 110 and the X electrodes 120*a* and 120*b* respectively comprise transparent electrodes 111, 121*a*, and 121*b* and metal bus electrodes 112, 122*a*, and 122*b*, which are located on the transparent electrodes 111, 121*a*, and 121*b* for supplementing transparent electrode conductivity.

According to the exemplary embodiment shown in FIG. 2, FIG. 3 and FIG. 4, each discharge cell in each column includes one Y electrode 110 located at its center and X electrodes 120*a* and 120*b* located at the adjacent barrier ribs in a row direction (X direction).

The transparent electrodes 121*a* and 121*b* of the X electrodes 120*a* and 120*b* may be arranged inside the discharge cells 60R, 60G and 60B, but the bus electrodes 122*a* and 122*b* may be arranged over the barrier ribs 42 to prevent them from being exposed in the discharge cells 60R, 60G and 60B. Thus, flow of the discharge current may be restricted, an increase of power consumption may be suppressed, and a voltage drop at the X electrode may be reduced so that uniform brightness may be achieved.

When an address voltage Va is applied to a discharge cell (for example, the discharge cell 60R between the address electrode 20 and the Y electrode 110 in FIG. 4), an address discharge occurs in the discharge cell, and a wall charge for selecting the discharge cell accumulates on the second dielectric layer 130.

Here, according to an exemplary embodiment of the present invention, since the Y electrode 110 is located at the middle of the discharge cell, the distance between the Y electrode 110 and the adjacent barrier ribs 42 may be maximized. Thus, the effect of the barrier ribs on the discharge between the address electrode 20 and the Y electrode 110 may be minimized. Therefore, the address discharge may be effectively performed, even when applying an address voltage that is lower than the conventional address voltage to the Y electrode.

Next, an operation in the sustain discharge period according to a first exemplary embodiment of the present invention is described with reference to FIG. 5 and FIG. 6.

Figure 5:
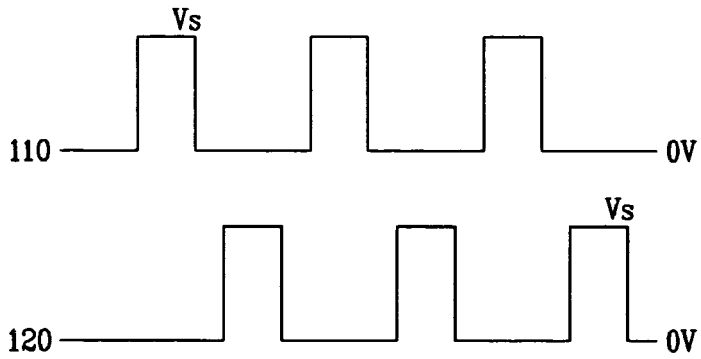
FIG. 5 shows a driving waveform according to an exemplary embodiment of the present invention.
Figure 6:
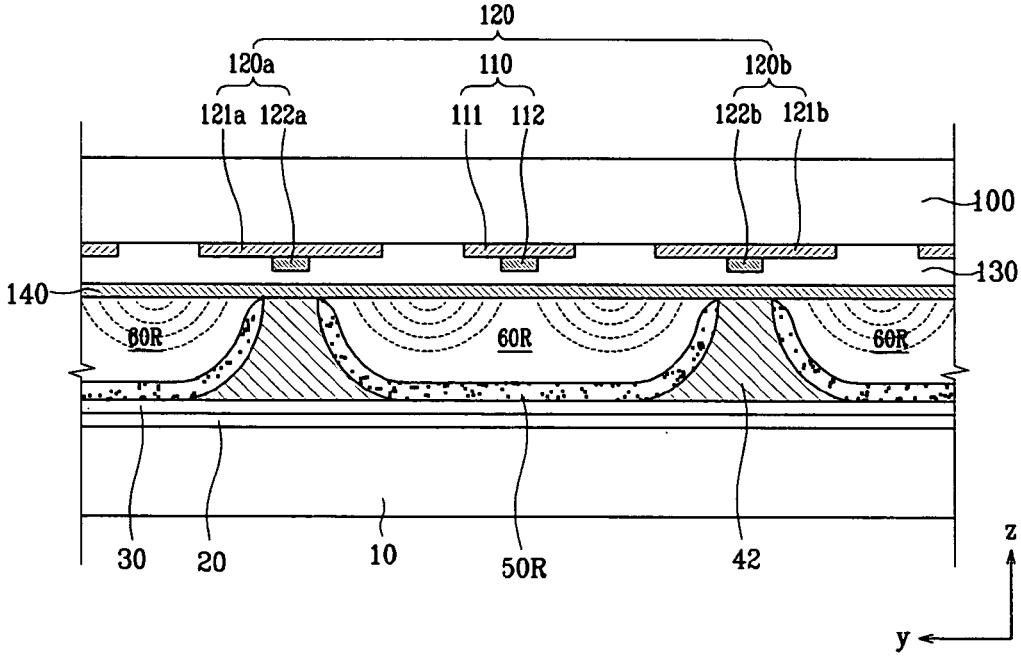
FIG. 6 shows a discharge condition in a PDP when applying the driving waveform of FIG. 5.

FIG. 5 shows a voltage waveform that may be applied to a Y electrode and an X electrode during the sustain discharge period according to the first exemplary embodiment, and FIG. 6 shows a discharge condition in the PDP when applying the voltage waveform in FIG. 5.

When the sustain discharge voltage Vs is alternately applied to the Y electrode 110 and the X electrode 120 after the address period, as shown in FIG. 5, a plasma discharge simultaneously occurs from a discharge gap between the Y electrode 110 and a first X electrode 120*a* and a discharge gap between the Y electrode 110 and a second X electrode 120*b*.

The plasma discharge is caused by a three-electrode structure in one discharge cell including a first X electrode 120*a*—a Y electrode 110—a second X electrode 120*b* (i.e., an XYX electrode arrangement). Therefore, according to an exemplary embodiment of the present invention, two discharges may simultaneously occur at one discharge cell, by two X electrodes located at left and right sides of the Y electrode, to achieve high brightness and efficiency.

According to an exemplary embodiment of the present invention, two X electrodes and one Y electrode may be arranged in one discharge cell to maximize sustain discharge efficiency. Therefore, one X electrode may be used for two adjacent discharge cells. Hence, the number of electrode lines for the whole panel need not increase.

The sustain discharge waveform shown in FIG. 5 may provide two discharges in one discharge cell. However, applying this waveform in all subfields may increase the brightness for a unit light, which may make low gray scale expression difficult.

In order to decrease the strength of a unit light, another exemplary embodiment of the present invention divides X electrodes into a group of odd numbered X electrodes and a group of even numbered X electrodes, and applies a sustain pulse to one of the X electrode groups in a subfield for a low gray scale expression.

Next, the operation in the sustain discharge period according to the second exemplary embodiment of the present invention is described with reference to FIG. 7A, FIG. 7B, FIG. 8 and FIG. 9.

Figure 7A:
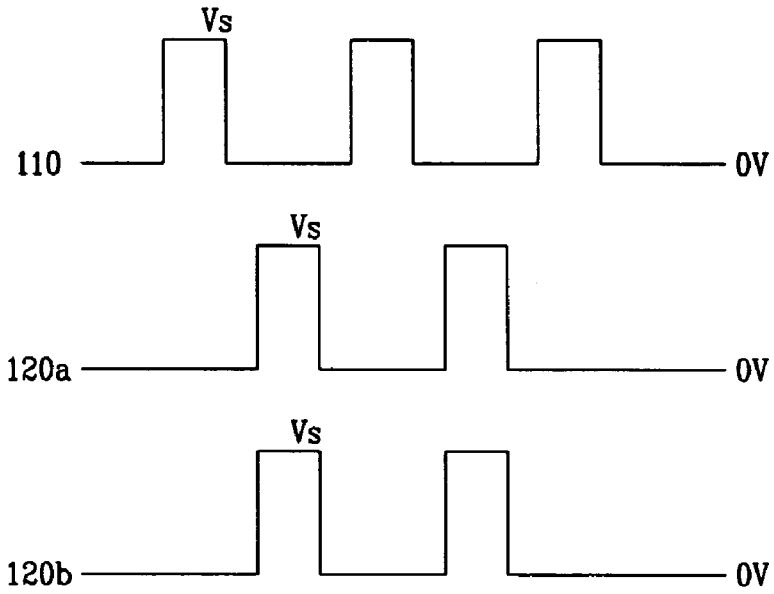
FIG. 7A and FIG. 7B show waveforms according to another exemplary embodiment of the present invention.
Figure 7B:
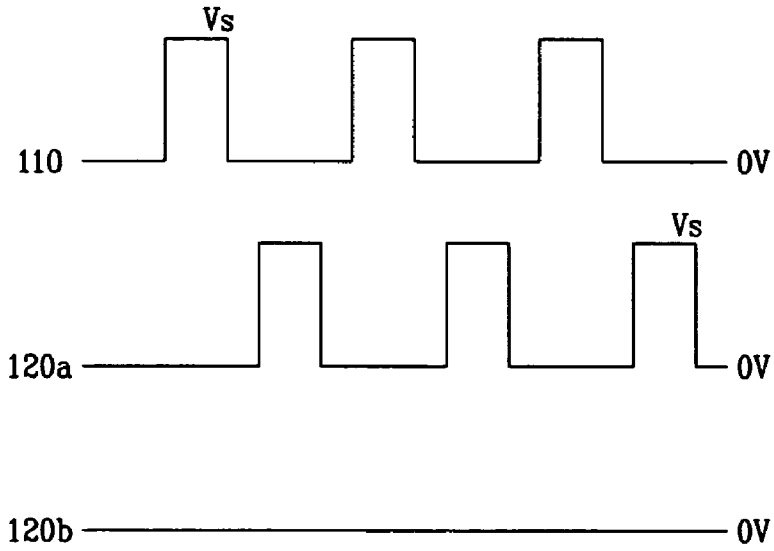
Figure 8:
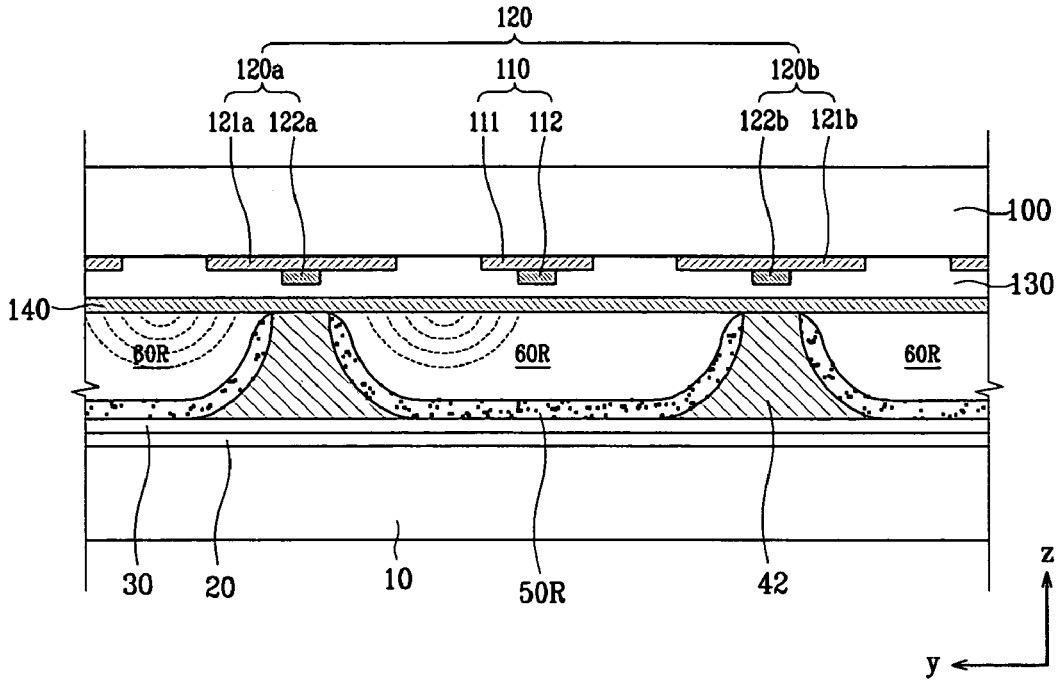
FIG. 8 shows a discharge condition in a PDP when applying the driving waveform of FIG. 7B.
Figure 9:
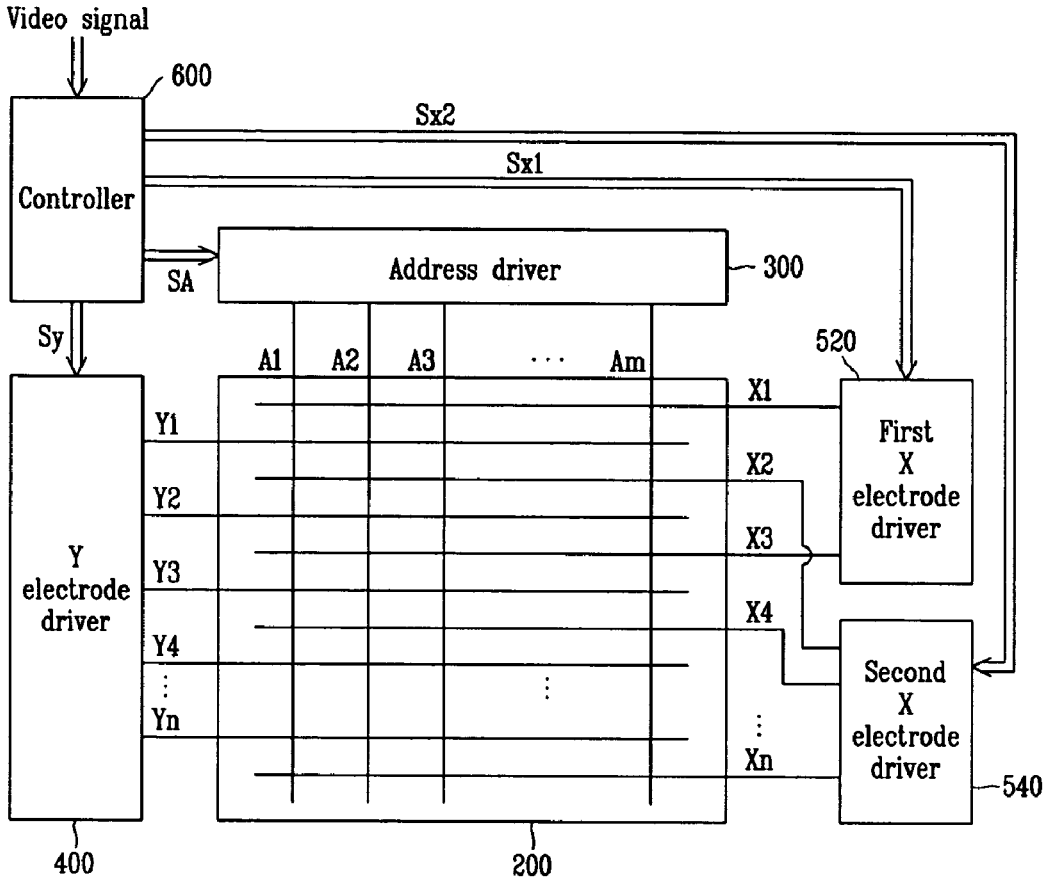
FIG. 9 shows a plasma display device according to an exemplary embodiment of the present invention.

FIG. 7A and FIG. 7B show voltage waveforms that may be applied to a Y electrode and X electrodes in a sustain discharge period according to an exemplary embodiment of the present invention. FIG. 8 shows a discharge condition in a PDP when applying the voltage waveform shown in FIG. 7B. Finally, FIG. 9 shows a plasma display device according to an exemplary embodiment of the present invention.

As shown in FIG. 7A, the sustain discharge voltage waveform may be simultaneously applied to a first X electrode 120*a*, which may be located at the left side of the Y electrode 110, and a second X electrode 120*b*, which may be located at the right side of the Y electrode 110.

As shown in FIG. 7B, during sustain discharge of a subfield for low gray scale expression, the sustain discharge voltage waveform may be applied to the first X electrode 120*a* (odd numbered X electrode), and a ground voltage may be applied to the second X electrode 120*b* (even numbered X electrode).

Thus, as shown in FIG. 8, the sustain discharge occurs between the Y electrode 110 and the odd numbered X electrode 120*a*, but it does not occur between the Y electrode 110 and the even numbered X electrode 120*b*. Therefore, one discharge occurs at the discharge cell, and the discharge may be much less than a discharge when applying the voltage waveform shown in FIG. 7A. Consequently, low gray scale expression may be maximized.

FIG. 7B and FIG. 8 show an embodiment applying the sustain discharge voltage to the odd numbered X electrode 120*a* and the Y electrode 110 while grounding the even numbered X electrode 120*b*. Alternatively, the sustain discharge voltage may be alternately applied to the even numbered X electrode 120*b* and the Y electrode 110 while grounding the odd numbered X electrode 120*a*.

Further, in the sustain discharge period of a subfield for the low gray scale expression, the sustain discharge voltage may be alternately applied to an odd numbered X electrode and to an even numbered X electrode, periodically. The period unit may be a frame unit, for example. As such, the sustain discharge may be uniformly maintained at the panel by alternately applying the sustain discharge voltage to the odd and even numbered X electrodes.

FIG. 9 shows a plasma display device according to an exemplary embodiment of the present invention.

As shown in FIG. 9, the plasma display device comprises a PDP 200, an address driver 300, a Y electrode driver 400, a first X electrode driver 520, a second X electrode driver 540, and a controller 600.

The PDP 200 comprises a plurality of address electrodes $A_1$ to $A_m$ arranged in a column direction, and a plurality of Y electrodes $Y_1$ to $Y_n$ and X electrodes $X_1$ to $X_n$ arranged in a zigzag pattern in a row direction. The X electrodes $X_1$ to $X_n$ may be arranged on barrier ribs (not shown), and they contribute to the sustain discharge of two adjacent discharge cells, as discussed above.

The controller 600 receives a video signal and generates an address driving control signal $S_A$, a Y electrode driving signal $S_Y$, a first X electrode driving control signal $S_{X1}$, and a second X electrode driving signal $S_{X2}$ and transfers the signals to the address driver 300, the Y electrode driver 400, the first X electrode driver 520, and the second X electrode driver 540, respectively.

The address driver 300 receives the address driving control signal $S_A$ and applies the data signal for display to each address electrode $A_1$ to $A_m$ to select a discharge cell to be displayed.

The Y electrode driver 400 receives the Y electrode driving signal $S_Y$ from the controller 600 and applies the data signal to the Y electrodes. The Y electrode driving signal $S_Y$ includes a scan signal for the address period and a sustain discharge signal for the sustain discharge period.

The first X electrode driver 520 receives the first X electrode driving signal $S_{X1}$ and applies the sustain discharge voltage waveform to a group of the odd numbered X electrodes, and the second X electrode driver 540 receives the second X electrode driving signal $S_{X2}$ and applies the sustain discharge voltage waveform to a group of the even numbered X electrodes.

According to an exemplary embodiment of the present invention, the controller 600 controls the first X electrode driver 520 and the second X electrode driver 540 so that only one of them applies a sustain discharge voltage in a subfield for low gray scale expression, but both apply the sustain discharge voltage in a normal subfield.

As described above, according to exemplary embodiments of the present invention, arranging a Y electrode passing through the middle of the discharge cell may minimize the effect of a barrier rib on an address discharge.

Further, X electrodes may be divided into two groups of X electrodes for driving, and only one group of X electrodes may be driven in a subfield for low gray scale expression. Thus, brightness of the unit light may be lowered, thereby improving low gray scale expression.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel including a first substrate and a second substrate facing each other with a plurality of discharge cells therebetween, a plurality of address electrodes arranged on the first substrate, a plurality of scan electrodes and a plurality of sustain electrodes alternately arranged on the second substrate, and wherein a discharge cell comprises a first sustain electrode, a second sustain electrode, and a scan electrode, the method comprising:

applying a scan voltage to the scan electrode and applying an address voltage to an address electrode to perform an address discharge;

alternately applying a sustain discharge voltage to the scan electrode and either the first sustain electrode or the second sustain electrode to perform a sustain discharge at an addressed discharge cell in a sustain period; and driving the plasma display panel through a plurality of subfields including a first subfield and a second subfield, wherein a sustain discharge voltage is alternately applied to the scan electrode and to either the first sustain electrode or the second sustain electrode in a sustain period of the first subfield; and wherein a sustain discharge voltage is alternately applied to the scan electrode and to the first sustain electrode and the second sustain electrode in a sustain period of the second subfield.

2. The driving method of claim 1, further comprising: biasing the second sustain electrode at a voltage in the sustain period of the first subfield.

3. The driving method of claim 1, wherein the sustain discharge voltage is simultaneously applied to the first sustain electrode and the second sustain electrode in the sustain period of the second subfield.

4. The driving method of claim 1, wherein the first subfield is a subfield for low gray scale expression.

5. A plasma display device, comprising:

a plasma display panel including a first substrate and a second substrate facing each other with a plurality of discharge cells therebetween, a plurality of scan electrodes and a plurality of sustain electrodes alternately arranged on the second substrate, and wherein a discharge cell comprises an odd numbered sustain electrode, an even numbered sustain electrode, and a scan electrode;

a first sustain electrode driver for applying a sustain discharge voltage, the first sustain electrode driver being coupled to odd numbered sustain electrodes;

a second sustain electrode driver for applying a sustain discharge voltage, the second sustain electrode driver being coupled to even numbered sustain electrodes; and a scan electrode driver for applying a scan signal and a sustain discharge voltage, the scan electrode driver being coupled to the plurality of scan electrodes, wherein the first sustain electrode driver applies the sustain discharge voltage to the odd numbered sustain electrode in a sustain period of a first subfield;

wherein the second sustain electrode driver applies a bias voltage to the even numbered sustain electrode in the sustain period of the first subfield; and wherein the first sustain electrode driver and the second sustain electrode driver apply the sustain discharge voltage to the odd numbered sustain electrode and the even numbered sustain electrode, respectively, in a sustain period of a second subfield.

6. The plasma display device of claim 5, wherein the first subfield is a subfield for low gray scale expression.

7. A method for driving a plasma display panel including a first substrate and a second substrate facing each other with a plurality of discharge cells therebetween, a plurality of address electrodes arranged on the first substrate, a plurality of scan electrodes and a plurality of sustain electrodes alternately arranged on the second substrate, and wherein a discharge cell comprises a first sustain electrode, a second sustain electrode, and a scan electrode, the method comprising:

in an address period, applying a scan voltage to the scan electrode and applying an address voltage to an address electrode to perform an address discharge; and in a sustain period, alternately applying a sustain discharge voltage to the scan electrode and to at least one on the first sustain electrode and the second sustain electrode to perform a sustain discharge at an addressed discharge cell, wherein the sustain discharge voltage is applied to only one of the first sustain electrode and the second sustain electrode in the sustain period to display a first gray scale; and wherein the sustain discharge voltage is applied to both of the first sustain electrode and the second sustain electrode in the sustain period to display a second gray scale, the second gray scale being higher than the first gray scale, the driving method further comprising:

in a first frame, driving the plasma display panel through a plurality of subfields including a first subfield and a second subfield, wherein the sustain discharge voltage is alternately applied to the scan electrode and to only the first sustain electrode in a sustain period of the first subfield; and wherein the sustain discharge voltage is alternately applied to the scan electrode and to both of the first sustain electrode and the second sustain electrode in a sustain period of the second subfield.

8. The driving method of claim 7, further comprising:

biasing the second sustain electrode at a voltage in the sustain period to display the first gray scale.

9. The driving method of claim 7, wherein the sustain discharge voltage is simultaneously applied to the first sustain electrode and the second sustain electrode in the sustain period to display the second gray scale.

10. The driving method of claim 7, wherein the second sustain electrode is biased at a voltage in the sustain period of the first subfield.

11. The driving method of claim 7, further comprising:

in a second frame following the first frame, driving the plasma display panel through a plurality of subfields including a third subfield and a forth subfield, wherein the sustain discharge voltage is alternately applied to the scan electrode and to only the second sustain electrode in a sustain period of the third subfield; and wherein the sustain discharge voltage is alternately applied to the scan electrode and to both of the first sustain electrode and the second electrode in a sustain period of the fourth subfield.

12. The driving method of claim 11, wherein the first sustain electrode is biased at a voltage in the sustain period of the third subfield.

13. The driving method of claim 12, wherein the second sustain electrode is biased at the voltage in the sustain period of the first subfield.

* * * * *